US009702643B1

(12) United States Patent
Viviano

(10) Patent No.: US 9,702,643 B1
(45) Date of Patent: Jul. 11, 2017

(54) BOLT CARRIER BEARING TUBE FOR RIFLE RECEIVER

(71) Applicant: Smith & Wesson Corp., Springfield, MA (US)

(72) Inventor: Matteo Viviano, Harrison Township, MI (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 15/457,407

(22) Filed: Mar. 13, 2017

Related U.S. Application Data

(62) Division of application No. 14/969,343, filed on Dec. 15, 2015.

(51) Int. Cl.

| | |
|---|---|
| ***F41A 3/26*** | (2006.01) |
| ***F41A 3/72*** | (2006.01) |
| ***F41A 3/66*** | (2006.01) |
| ***F41A 9/65*** | (2006.01) |
| ***F41A 15/16*** | (2006.01) |
| ***F41A 21/48*** | (2006.01) |

(52) U.S. Cl.
CPC *F41A 3/26* (2013.01); *F41A 3/66* (2013.01); *F41A 3/72* (2013.01); *F41A 9/65* (2013.01); *F41A 15/16* (2013.01); *F41A 21/482* (2013.01)

(58) Field of Classification Search
CPC ..... F41A 3/26; F41A 3/66; F41A 3/72; F41A 9/65; F41A 5/18; F41A 5/20; F41A 5/22; F41A 5/24; F41A 5/26; F41A 5/28; F41A 5/30
USPC ..... 42/75.03, 75.02, 18; 89/198, 128, 89/191.01, 179, 199, 194, 4.1
See application file for complete search history.

(56) References Cited

U.S. PATENT DOCUMENTS

| | | | | |
|---|---|---|---|---|
| 4,703,826 | A | 11/1987 | Byron | |
| 4,838,143 | A | 6/1989 | Byron | |
| 4,926,739 | A | 5/1990 | Byron | |
| 4,947,730 | A | 8/1990 | Byron | |
| 5,590,484 | A | 1/1997 | Mooney et al. | |
| 5,900,577 | A | 5/1999 | Robinson et al. | |
| 6,019,024 | A | 2/2000 | Robinson et al. | |
| 7,596,900 | B2 * | 10/2009 | Robinson | F41A 15/12 42/49.01 |
| 7,775,150 | B2 | 8/2010 | Hochstrate et al. | |
| 7,971,379 | B2 | 7/2011 | Robinson et al. | |
| 8,141,287 | B2 | 3/2012 | Dubois | |
| 8,336,243 | B2 | 12/2012 | Langevin et al. | |
| 8,356,439 | B2 | 1/2013 | Dubois | |
| 8,528,243 | B1 | 9/2013 | Glock | |
| 8,615,916 | B2 | 12/2013 | Bassoli et al. | |
| 8,776,420 | B2 | 7/2014 | Langevin et al. | |
| 8,789,305 | B1 | 7/2014 | DiChario | |
| 8,826,797 | B2 | 9/2014 | Overstreet et al. | |
| 9,003,684 | B2 | 4/2015 | Bero | |

(Continued)

*Primary Examiner* — John D Cooper
(74) *Attorney, Agent, or Firm* — John A. Chionchio, Esquire; Ballard Spahr LLP

(57) ABSTRACT

A metal tube provides a bearing for a bolt carrier in a rifle. The tube is machined to provide openings and co-molded with a polymer outer shroud to form a lightweight composite upper receiver. The tube has an inner surface that supports the bolt carrier in its reciprocal motion during cycling of the rifle action during firing. The length and diameter of the tube are designed to prevent tilt of the bolt carrier during operation.

13 Claims, 4 Drawing Sheets

(56) References Cited

U.S. PATENT DOCUMENTS

| | | | | |
|---|---|---|---|---|
| 9,068,786 | B2 | 6/2015 | DiChario | |
| 2010/0162604 | A1* | 7/2010 | Dubois | F41A 21/482 42/18 |
| 2012/0144712 | A1* | 6/2012 | Rostocil | F41A 9/79 42/16 |
| 2015/0000171 | A1* | 1/2015 | Roberts | F41A 3/66 42/75.03 |
| 2015/0007477 | A1 | 1/2015 | Langevin et al. | |
| 2015/0052794 | A1 | 2/2015 | Underwood et al. | |
| 2015/0107144 | A1 | 4/2015 | DiChario | |
| 2015/0135573 | A1* | 5/2015 | DiChario | F41G 11/003 42/75.02 |
| 2015/0226501 | A1 | 8/2015 | Gibbens et al. | |
| 2016/0033219 | A1* | 2/2016 | Meier | F41A 3/66 89/191.01 |

* cited by examiner

FIG. 2
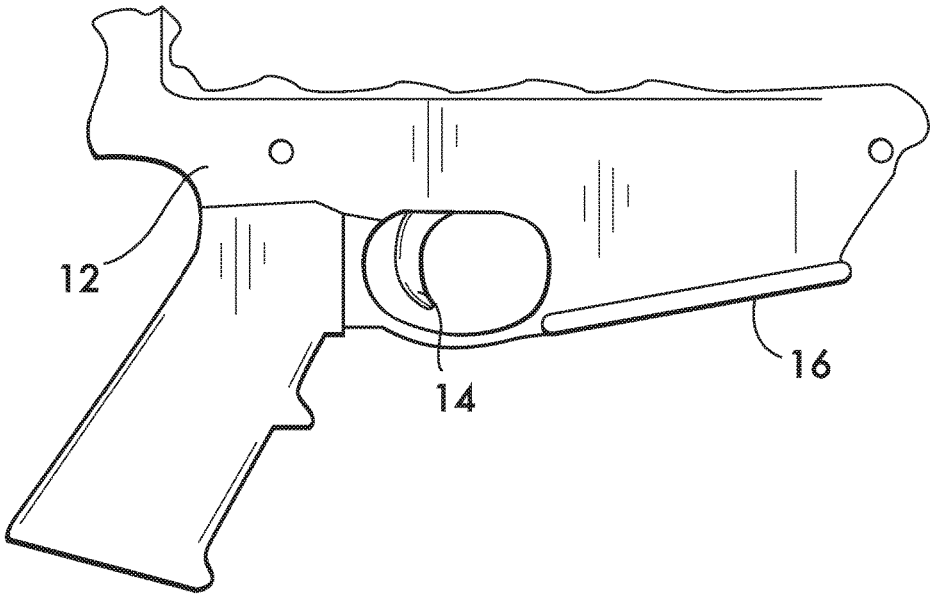
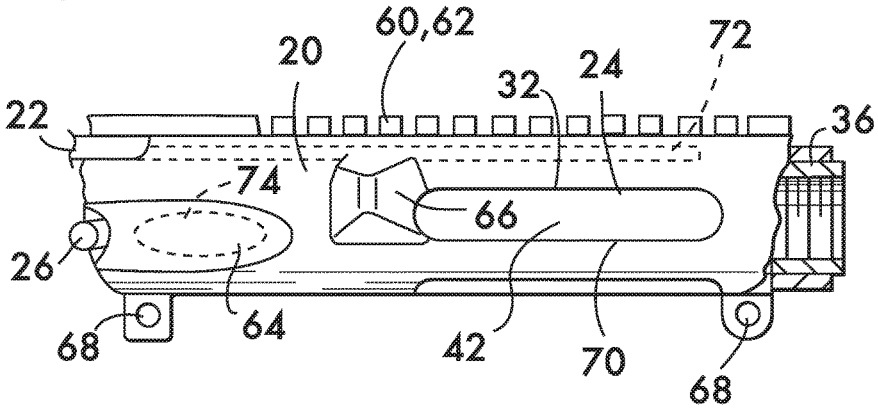
FIG. 3

BOLT CARRIER BEARING TUBE FOR RIFLE RECEIVER

CROSS REFERENCE TO RELATED APPLICATION

This application is a divisional of and claims benefit of priority to U.S. application Ser. No. 14/969,343, filed Dec. 15, 2015, which application is hereby incorporated by reference.

FIELD OF THE INVENTION

This invention relates to rifles for military and civilian sporting use.

BACKGROUND

Modern sporting rifles as well as military rifles and carbines must be robust for reliable operation, and lightweight to permit carry without excessive fatigue. Significant reduction in rifle weight has been previously achieved by replacing wood with polymer material for components such as the shoulder stock and fore stock. Such designs have been successful because the use of polymer material for these elements does not compromise the robustness or reliable operation of modern firearms.

However, components such as the receiver and its associated assemblies such as the bolt carrier and barrel still account for a significant portion of the weight of a firearm, as it has not been thought feasible to substitute polymer for such parts which experience heat, pressure and wear from reciprocating motion. To meet the harsh requirements of operation many receiver designs are machined from a solid aluminum billet, and thus represent, in addition to significant weight, a significant production cost, as the machining is complex and constrained by tight tolerance requirements. There is clearly a need to further reduce rifle weight and simplify production without compromising the performance of the modern combat or sporting rifle.

SUMMARY

The invention concerns a bearing for a bolt carrier in an upper receiver of a firearm having a charging handle, a fire control mechanism and a magazine. In one example embodiment the bearing comprises a tube positionable within the upper receiver. The tube has a sidewall defining an inner surface supporting the bolt carrier and motion thereof between an open position and a battery position. A first opening in the sidewall defines an ejector port. A second opening in the sidewall is positioned to permit engagement between the bolt carrier and the charging handle. A third opening in the sidewall receives the fire control mechanism or the magazine.

By way of example a fourth opening in the sidewall receives the fire control mechanism or the magazine. In an example embodiment, the tube has a buffer tube radius for attaching a buffer tube to the tube. In a specific example the second opening is positioned diametrically opposite to the third opening. In a further specific example the second opening is positioned diametrically opposite to the fourth opening. In another example the first opening is positioned angularly offset from the second opening about a longitudinal axis of the tube. In an example embodiment the second opening comprises a slot extending lengthwise along the tube, one end of the slot being open. In a further example the third and fourth openings are contiguous with one another. In another example the fourth opening is wider than the third opening.

By way of example one end of the tube comprises screw threads. In a particular example the screw threads are positioned on the inner surface. In another example the screw threads are positioned on an outer surface of the tube. An example embodiment further comprises an aperture in the sidewall for permitting engagement between the bolt carrier and a forward assist button.

The invention also encompasses an upper receiver of a firearm having a bolt carrier, a charging handle, a fire control mechanism and a magazine. In this example embodiment the upper receiver comprises a metal tube having a sidewall defining an inner surface supporting the bolt carrier and motion thereof between an open position and a battery position. A polymer shroud surrounds at least a portion of the metal tube. A first opening, positioned in the sidewall and a first opening, positioned in the polymer shroud overlying the first opening in the sidewall define an ejector port.

By way of example the invention further comprises a second opening in the sidewall and a second opening in the polymer shroud overlying the second opening in the sidewall. The second openings are positioned to permit engagement between the bolt carrier and the charging handle.

An example embodiment further comprises a third opening in the sidewall for receiving the fire control mechanism or the magazine. Another example comprises a fourth opening in the sidewall for receiving the fire control mechanism or the magazine. Another example embodiment comprises a rail mounted on the shroud. The rail and extends lengthwise along the tube and comprises a plurality of ribs oriented transversely to a longitudinal axis of the tube. Further by way of example the shroud comprises an outwardly projecting surface positioned adjacent to the ejector port. Another example further comprises a housing extending from the shroud for receiving a forward assist button. In this example the metal tube comprises an aperture aligned with the housing for permitting engagement between the bolt carrier and the forward assist button.

By way of example the invention further comprises first and second lugs positioned at opposite ends of the shroud for attaching the shroud to a lower receiver. Another example embodiment of the invention comprises a buffer tube radius for attaching a buffer tube to the metal tube.

By way of example, the first openings are positioned angularly offset from the second openings about a longitudinal axis of the metal tube. In a further example, the second opening in the sidewall of the metal tube comprises a slot extending lengthwise along the metal tube, one end of the slot being open.

In an example embodiment, one end of the metal tube comprises screw threads. In a specific example the screw threads are positioned on the inner surface of the metal tube. In another example embodiment, the screw threads are positioned on an outer surface of the metal tube.

The invention also encompasses firearm having a bolt carrier, a charging handle, a fire control mechanism and a magazine. In an example embodiment the firearm comprises an upper receiver comprising a metal tube having a sidewall defining an inner surface supporting the bolt carrier and motion thereof between an open position and a battery position. A polymer shroud surrounds at least a portion of the metal tube. A first opening is positioned in the sidewall and a first opening in the polymer shroud overlies the first opening in the sidewall. The first openings define an ejector port.

In an example embodiment a second opening in the sidewall and a second opening in the polymer shroud overlying the second opening in the sidewall are positioned to permit engagement between the bolt carrier and the charging handle.

In another example a third opening in the sidewall receives the fire control mechanism or the magazine. In a further example the invention comprises a fourth opening in the sidewall for receiving the fire control mechanism or the magazine. In a specific example embodiment a rail is mounted on the shroud and extends lengthwise along the tube. The rail comprises a plurality of ribs oriented transversely to a longitudinal axis of the tube. By way of example the shroud further comprises an outwardly projecting surface positioned adjacent to the ejector port.

In an example embodiment the firearm further comprises a housing extending from the shroud for receiving a forward assist button. The metal tube comprises an aperture aligned with the housing for permitting engagement between the bolt carrier and the forward assist button.

By way of further example, first and second lugs are positioned at opposite ends of the shroud for attaching the shroud to a lower receiver. A particular example comprises a buffer tube radius for attaching a buffer tube to the metal tube. In a specific example the first openings are positioned angularly offset from the second openings about a longitudinal axis of the metal tube. In another example the second opening in the sidewall of the metal tube comprises a slot extending lengthwise along the metal tube, one end of the slot being open. By way of example, one end of the metal tube comprises screw threads. In a specific example the screw threads are positioned on the inner surface of the metal tube. In another example, the screw threads are positioned on an outer surface of the metal tube.

BRIEF DESCRIPTION OF THE DRAWINGS

FIG. 2 is a right side view of the lower receiver of the rifle shown in FIG. 1;

FIG. 3 is a right side view of the upper receiver of the rifle shown in FIG. 1;

DETAILED DESCRIPTION

Figure 1:
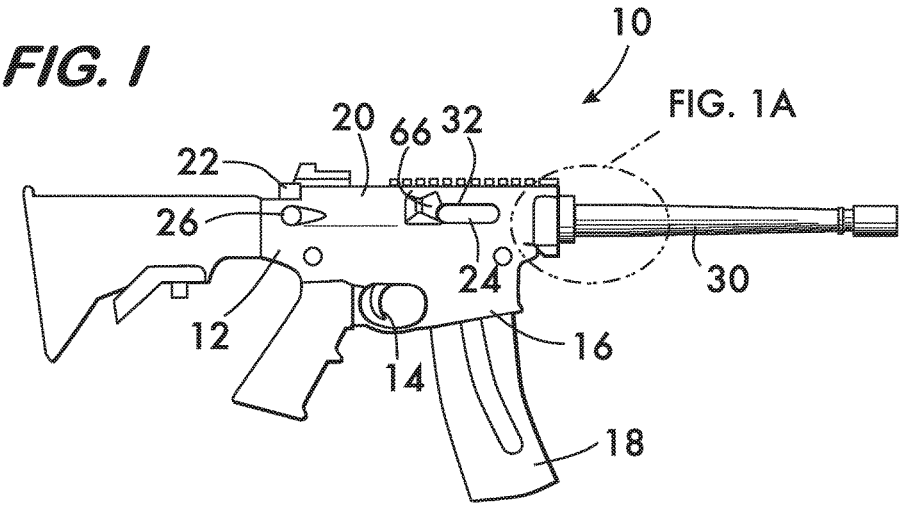
FIG. 1 is a right side view of an example rifle according to the invention.

FIG. 1 depicts an example embodiment of a rifle 10 according to the invention. Rifle 10 may be capable of automatic or semi-automatic operation and comprises a lower receiver 12 (see also FIG. 2) which houses a fire control mechanism 14 (see also FIG. 4) and has a magazine well 16 which receives an ammunition magazine 18. An upper receiver 20 (see also FIG. 3) is attached to the lower receiver 12. The upper receiver houses a charging handle 22, a bolt carrier 24 (see also FIG. 4) and may also house a forward assist button 26.

During operation of the rifle 10, the bolt carrier 24 (see FIG. 4) reciprocates within the upper receiver 20 between "battery", a position wherein the bolt 28 on the bolt carrier 24 is engaged with the breech of barrel 30 (see FIG. 1A), and an open position, where the bolt 28 is disengaged from the breech and the bolt carrier 24 is retracted away from the breech. In battery, a round chambered in the breech may be discharged. Upon discharge, the bolt carrier 24 moves from battery to the open position, extracting and ejecting the spent cartridge and resetting the fire control mechanism 14 along the way. Motion of the bolt carrier 24 from battery to the open position also compresses a return spring (not shown) acting on the bolt carrier. As the bolt carrier 24 moves back into battery (driven by the return spring) it strips a round from the magazine 18 and chambers it in the breech of barrel 30 completing the cycle. Energy for moving the bolt carrier 24 through this cycle (in either automatic or semi-automatic operation) is provided by the ammunition itself using one of at least three well understood modes of operation commonly known as "recoil", "blow-back", and "gas" operation. A round is initially chambered and the fire control mechanism 14 is initially set by drawing and releasing the charging handle 22, which draws the bolt carrier 24 from battery to the open position and permits the bolt carrier to move back into battery, driven by the aforementioned return spring (not shown).

Thus the upper receiver 20 must support the bolt carrier 24 as it moves between battery and the open position but also allow the various components, including the fire control mechanism 14, the magazine 18, the charging handle 22, and the forward assist button 26 (when present) to interact with the bolt carrier. The upper receiver 20 must also provide an ejection port 32 to permit ejection of the spent cartridge. In the upper receiver 20 according to the invention the bolt carrier 24 is supported by a bearing 34, shown in FIGS. 4-6. Bearing 34 comprises a metal tube 36, which may be formed from aluminum, steel or other durable metals. Tube 36 in this example has a round cross section defined by a sidewall 38. Sidewall 38 also defines an inner surface 40 which supports the bolt carrier 24 in its reciprocal motion between battery and the open position. Tube 36 is sized in both length and inner diameter so that tilting of the bolt carrier 24 relative to the longitudinal axis 52 of tube 36 is mitigated to ensure smooth motion during operation for reliability.

Figure 4:
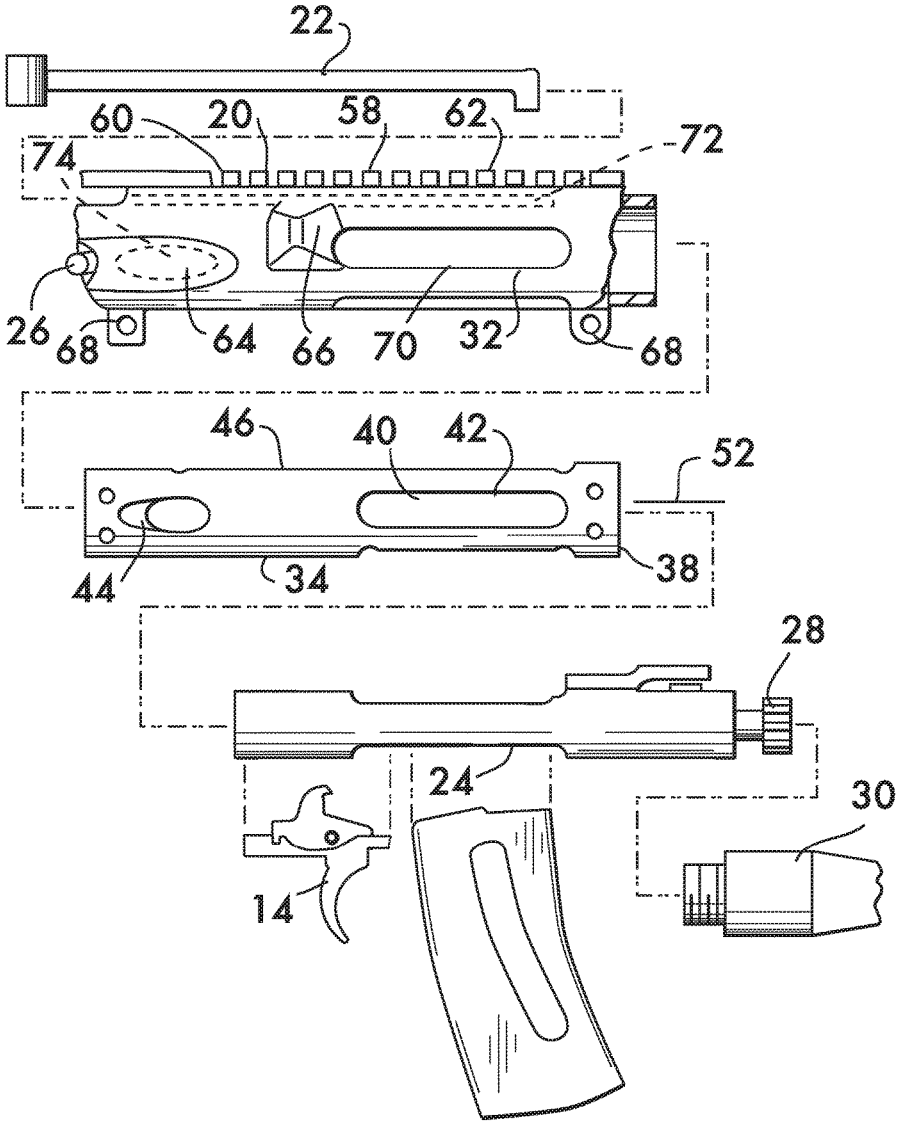
FIG. 4 is an exploded side view of the upper receiver of the rifle shown in FIG. 1.
Figure 5:
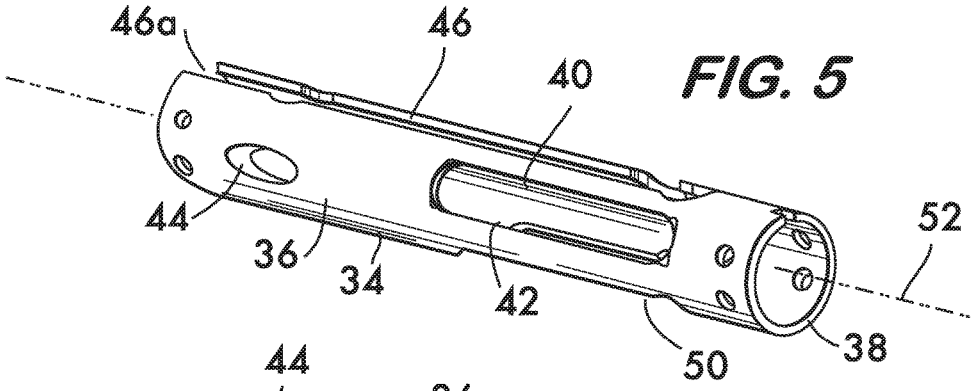
FIG. 5 is an isometric view of an example bearing used in an upper receiver of a rifle.
Figure 6:
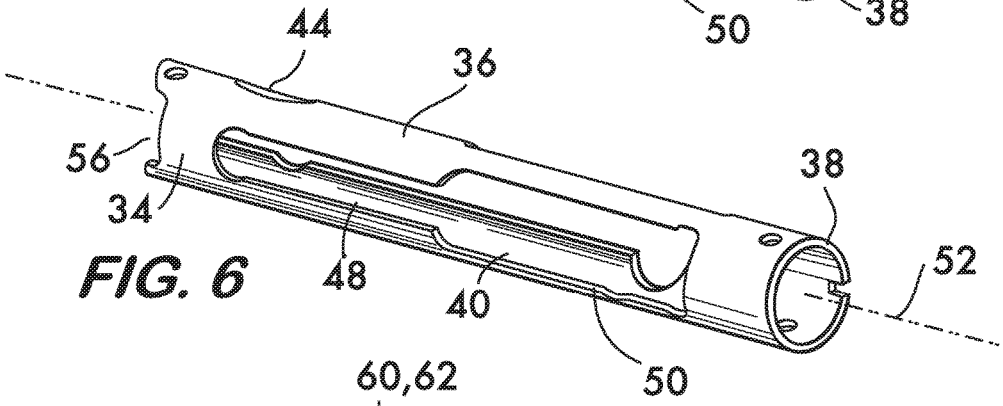
FIG. 6 is an isometric view of the bearing shown in FIG. 5 rotated 90° about its longitudinal axis in a clockwise direction.

As shown in FIGS. 4 and 5, an ejector port 42 is provided within the sidewall 38 to permit ejection of spent cartridges from the receiver. An aperture 44 is also provided within the sidewall 38 to permit the forward assist button 26 to engage the bolt carrier 24 and drive it into battery when the return spring fails to do so. FIG. 5 illustrates yet another opening 46 in the sidewall 38 which is positioned to permit the charging handle 22 to engage the bolt carrier 24. FIG. 6 illustrates additional openings 48 and 50. Opening 48 permits at least a portion of the fire control mechanism 14 (see FIG. 4) to extend into the tube 36 and interact with the bolt carrier 24. Opening 50 permits the magazine 18 to extend into the tube 36 so that rounds can be stripped and chambered as the bolt carrier 24 moves into battery.

As shown by way of example in FIGS. 5 and 6, the opening 46 for charging handle 22 is diametrically opposite to the openings 48 and 50 for the fire control mechanism 14 and the magazine 18. This configuration is dictated by the layout of the rifle 10 shown in FIG. 1, wherein the charging handle 22 is positioned on the upper receiver 20 and substantially aligned with the fire control mechanism 14 and the magazine well 16 which receives the magazine 18, all of which are housed in the lower receiver 12. Ejector port 42 (see FIGS. 4 and 5) is angularly offset from the charging handle opening 46 about the longitudinal axis 52 of the tube 36 to direct the spent cartridges to the right side of the rifle 10. Other arrangements of the openings in tube 36 are of course feasible to accommodate other rifle configurations. The openings are further shaped and dimensioned commensurate with their respective functions. To this end, opening 46 in this example comprises an elongate slot to accommodate the necessary range of motion of the charging handle 22 and bolt carrier 24 along the tube 36. In this example one end 46*a* of the slot formed by opening 46 is open. Similarly, openings 48 and 50 are sized to accommodate the fire control mechanism and magazine, respectively, opening 50 being wider than opening 48 as a result. The openings 48 and 50 may be contiguous with one another as shown.

The simplicity of the bearing 34 allows the various openings to be conveniently formed by laser machining techniques. Traditional machining techniques are of course also feasible.

Figure 1A:
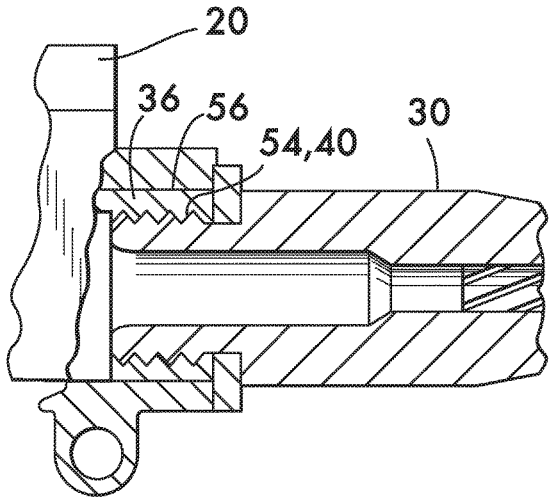
FIG. 1A is a longitudinal sectional view taken from within the ellipse of FIG. 1.

As further shown in FIG. 1A, tube 36 may have screw threads 54 positioned at the end which interfaces with the barrel 30 (see also FIG. 1). Threads 54 may be on the inner surface 40 of the tube 36 (shown) or on the outer surface 56. Additionally, as shown in FIG. 6, a buffer tube radius 56 may also be part of tube 36 for accommodating a buffer tube (not shown), which contains the return spring (not shown).

Figure 7:
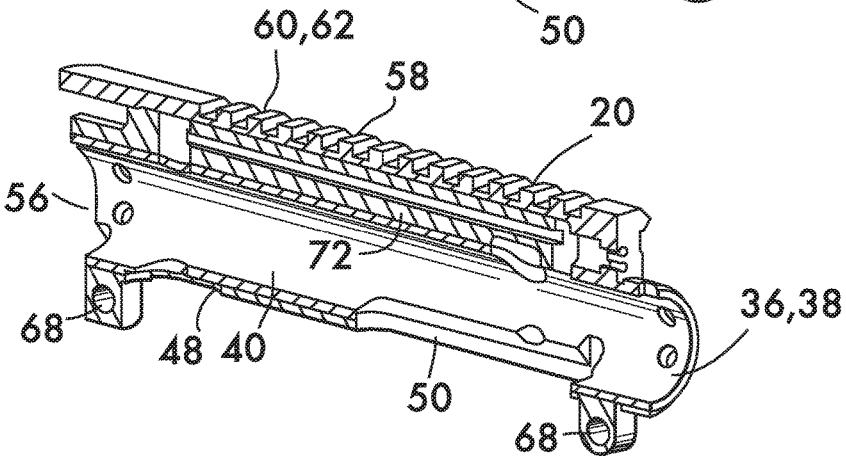
FIG. 7 is an isometric longitudinal sectional view of a portion of an example upper receiver according to the invention.

Another part of the upper receiver according to the invention is the polymer shroud 58, an example being shown in FIG. 4. Shroud 58 is formed from a polymer such as fiber reinforce nylon which, as shown in FIGS. 3 and 7, is injection molded around a tube 36 that has already been machined and finished. In production a machined, finished tube 36 is placed in a mold for the upper shroud, the mold is closed, and the polymer is injected into the mold in a co-molding process that joins shroud and tube. Injection molding is advantageous because it permits features having complex geometries to be incorporated into the upper receiver while avoiding costly and time consuming machining. The example shroud 58 includes a so-called "Picatinny" rail 60 that extends lengthwise along the tube 36 and has a plurality of transverse ribs 62. Also shown in FIG. 3 are a housing 64 for the forward assist button 26 and an outwardly projecting surface 66 adjacent to the ejector port 42 for deflecting ejected cartridges. Lugs 68 for attaching the upper receiver 20 to the lower receiver 12 may also be injection molded as part of shroud 58.

Injection molding also allows openings to be formed in the shroud 58 that correspond to openings in the tube 36. As shown in FIGS. 3 and 4, opening 70 in shroud 58 aligns with the ejector port opening 32 in the tube 36; opening 72 in the shroud aligns with the opening 46 for the charging handle 22; and opening 74 aligns with aperture 44 for the forward assist button 26. In the example shroud 58 the region between the lugs 68 is substantially open to permit the fire control mechanism 14 and the magazine 18 to be received within respective openings 48 and 50 in the sidewall 38 of tube 36 when the upper receiver 20 is mounted on the lower receiver 12 and the magazine 18 is inserted into magazine well 16.

A rifle having a polymer upper receiver co-molded with a tube comprising a bearing for supporting and guiding a bolt carrier provides numerous advantages over traditional rifles wherein the receiver is machined from a billet. Such rifles will have reduced weight and more economical and rapid production without sacrificing reliability or robustness.

What is claimed is:

1. A bearing configured to support a bolt carrier in an upper receiver of a firearm having a charging handle, a fire control mechanism and a magazine, said bearing comprising:

a tube positionable within said upper receiver, said tube having a sidewall defining an inner surface configured to support said bolt carrier and motion thereof between an open position and a battery position;

a first opening in said sidewall defining an ejector port;

a second opening in said sidewall positioned to permit engagement between said bolt carrier and said charging handle;

a third opening in said sidewall for receiving said fire control mechanism or said magazine.

2. The bearing according to claim 1, further comprising a fourth opening in said sidewall configured to receive said fire control mechanism or said magazine.

3. The bearing according to claim 2, wherein said second opening is positioned diametrically opposite to said fourth opening.

4. The bearing according to claim 2, wherein said third and fourth openings are contiguous with one another.

5. The bearing according to claim 2, wherein said fourth opening is wider than said third opening.

6. The bearing according to claim 1, further comprising a buffer tube radius configured to permit attachment of a buffer tube to said tube.

7. The bearing according to claim 1, wherein said second opening is positioned diametrically opposite to said third opening.

8. The bearing according to claim 1, wherein said first opening is positioned angularly offset from said second opening about a longitudinal axis of said tube.

9. The bearing according to claim 1, wherein said second opening comprises a slot extending lengthwise along said tube, one end of said slot being open.

10. The bearing according to claim 1, wherein one end of said tube comprises screw threads.

11. The bearing according to claim 10, wherein said screw threads are positioned on said inner surface.

12. The bearing according to claim 10, wherein said screw threads are positioned on an outer surface of said tube.

13. The bearing according to claim 1, further comprising an aperture in said sidewall configured to permit engagement between said bolt carrier and a forward assist button.

* * * * *